US009731313B1

(12) United States Patent
Williams et al.

(10) Patent No.: US 9,731,313 B1
(45) **Date of Patent: *Aug. 15, 2017**

(54) APPLICATION OF SUBSTANCE TO PROTRUSION

(71) Applicants: Craig A. Williams, Maumee, OH (US); Bradley A. Spraw, Maumee, OH (US)

(72) Inventors: Craig A. Williams, Maumee, OH (US); Bradley A. Spraw, Maumee, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/935,492

(22) Filed: Nov. 9, 2015

Related U.S. Application Data

(62) Division of application No. 14/219,120, filed on Mar. 19, 2014, now Pat. No. 9,180,480.

(60) Provisional application No. 61/803,189, filed on Mar. 19, 2013.

(51) Int. Cl.

| | |
|---|---|
| ***A46B 11/00*** | (2006.01) |
| ***B05C 1/02*** | (2006.01) |
| ***C23C 22/73*** | (2006.01) |
| ***B05D 1/28*** | (2006.01) |

(52) U.S. Cl.
CPC ..... *B05C 1/02* (2013.01); *B05C 1/027* (2013.01); *B05D 1/28* (2013.01); *C23C 22/73* (2013.01)

(58) Field of Classification Search
CPC .. B05C 1/027; B05C 1/02; B05C 1/06; B05C 1/022
USPC ..... 401/11, 203, 282; 118/264, 266–270, 118/DIG. 11; 15/244.1, 244.4
See application file for complete search history.

(56) References Cited

U.S. PATENT DOCUMENTS

| | | | | |
|---|---|---|---|---|
| 4,440,207 | A * | 4/1984 | Genatempo | A61L 31/16 150/154 |
| 5,743,359 | A * | 4/1998 | Parnell | F16N 7/12 118/268 |
| 6,547,880 | B1 * | 4/2003 | Krueger | B05C 1/06 118/264 |
| 7,232,273 | B2 * | 6/2007 | Nealon | B05C 17/00516 401/265 |
| 8,770,881 | B2 * | 7/2014 | Dam | A61L 2/18 401/10 |
| 2012/0291700 | A1 * | 11/2012 | Thommes | B05C 17/002 118/270 |

* cited by examiner

*Primary Examiner* — Jennifer C Chiang
(74) *Attorney, Agent, or Firm* — Donald K. Wedding

(57) ABSTRACT

A fluid applicator for applying a fluid to a surface protrusion. In one embodiment, an anticorrosion substance is applied to a structural fastener.

8 Claims, 10 Drawing Sheets

APPLICATION OF SUBSTANCE TO PROTRUSION

RELATED APPLICATION

This application is a division under 35 U.S.C. 120 from U.S. patent application Ser. No. 14/219,120 filed Mar. 19, 2014 to issue as U.S. Pat. No. 9,180,480 on Nov. 10, 2015, which claims priority under 35 U.S.C. 119(e) from Provisional U.S. Patent Application Ser. No. 61/803,189 filed Mar. 19, 2013, both incorporated herein by reference.

INTRODUCTION

This invention relates to fluid applicators. Examples of fluid applicators are disclosed in U.S. Pat. No. 5,131,349 (Keller et al.), U.S. Pat. No. 5,743,959 (Ash et al.), U.S. Pat. No. 6,547,880 (Krueger et al.), and U.S. Design Pat. Nos. 480,959 (DeWood), 480,632 (Williams et al.), 468,633 (DeWood), all incorporated herein by reference.

In accordance with this invention, there is provided a fluid applicator with a hollow body or base containing a porous material with an aperture formed to a predetermined depth and diameter for uniformly applying a selected fluid to a surface protrusion such as a structural fastener.

In one embodiment, an anticorrosion substance or material is controllably and uniformly applied to a surface protrusion such as structural fasteners used in the assembly of an aircraft body. The anticorrosion substance is a fluid, typically an anticorrosion liquid such as a corrosion resistant conversion composition as disclosed in U.S. Pat. No. 7,452,427 (Morris) and U.S. Patent Application Publication 2009/0065101 (Morris), both incorporated herein by reference.

In such embodiment, there is provided apparatus and method for applying an anticorrosion substance to structural fasteners by positioning a female aperture of porous material over a male protrusion or fastener and controllably flowing the anticorrosion substance to the porous material so as to uniformly coat the fastener with the substance.

BACKGROUND

The fluid applicator is of any suitable geometric shape and comprises a hollow polymeric body or base with a porous material inside the hollow body. The applicator may contain additional structure such as a neck or nozzle for the flow of fluid from a source to the hollow body.

The body or base of the fluid applicator is typically made of a polymeric substance, for example a thermoplastic such as high-density polyethylene or high strength polypropylene including composites or blends thereof. In one preferred embodiment, there is used high-density polyethylene. However, there may be used other polymer materials such as polyvinyl chloride, polycarbonate, and polyamides. Composites or blends may be used, particularly composites or blends of high-density polyethylene and high strength polypropylene. The applicator body may be made of a wide range of other materials including rubber, ceramic, glass, glass ceramic, or sintered powdered metal.

Porous Material

The fluid applicator contains a porous material within the body. The porous material is an organic (natural) material or a synthetic material with a wicking property so that the porous material readily absorbs a fluid such as a liquid for transfer to the protrusion such as a fastener. Wicking typically comprises the absorption of the liquid into the porous material by capillary action. The absorbed liquid is dispensed by the porous material and deposited on the protrusion.

The porous material is typically made from one or more wicking materials that comprise a matrix of felted, woven, or non-woven fibers or filaments. The porous material may comprise a single thickness of the selected material or multiple plies or layers depending upon the required flow properties, flow characteristics, flow rates, and other factors that may affect the dispensing of the liquid.

Depending upon the application, the porous material is used in any geometric form or shape suitable for the dispensing of the fluid to the protrusion. The criteria for selecting the porous material include the compatibility of the porous material with the fluid and/or solids to be dispensed including the chemical composition and flow properties such as viscosity of the fluid and/or solids. The properties and characteristics of the selected porous material including chemical composition, thickness, geometry, and porosity are determined by the properties and characteristics of the fluid to be flowed and dispensed, including any solids carried in the fluid. The selected porous material should be chemically resistant or inert to the fluid.

The internal construction of the porous material may comprise a single or multiple plies, homogeneous or non-homogeneous composition(s) and may comprise a composite and/or blend of several materials. The porous material is selected to provide the desired flow or percolation rate for the fluid and/or solids.

The flow or percolation rate may be determined for a liquid by the capillary action of the porous material and by the gravity or pressure feed of the liquid to the porous material. The properties that affect liquid flow through the porous material include liquid viscosity, liquid temperature, liquid chemical composition, reactivity of the liquid with the porous material, the liquid holding capacity of the porous material, and the geometric form or shape of the porous material. The porous material may be in any suitable geometric form or shape that absorbs the liquid and deposits it on the protrusion. In one embodiment, the porous material is in the shape of a resilient pad.

The composition of contemplated porous materials include organic or natural substances with a suitable wicking property such as cotton foam, natural sponge, cloth, wool, plant fiber, bristles, hemp, animal fur, human hair, and animal hair. Animal hair includes horse hair, camel hair, and goat hair. In one specific embodiment, there is used goat hair such as mohair.

The porous materials also include synthetic substances such as synthetic sponge, foams, glass fibers, metal fibers, and polymeric substances including polymeric fibers. Examples of polymeric substances include polyamides and polyesters. The polyamides include nylon, nylon-6, and nylon-6,6. The polyesters include condensation polymers that contain an ester functional group in the primary or main chain such as polycarbonate and polyethylene terephthalate (PET). In one specific embodiment, there is used a felt or porous material made from polyester such as PET. In another embodiment, there is used a composite of polyester such as PET and a polyamide such as nylon.

There may be used an open cell foam such as melamine foam as disclosed in U.S. Pat. No. 5,436,278 (Imashiro et al.), U.S. Pat. No. 6,800,666 (Hahnle et al.), and European Patent 0992532 (Imashiro et al.), all incorporated herein by reference. Other open cell foams may be used such as polyurethane foams as disclosed in U.S. Pat. No. 4,334,031

(Otten et al.), U.S. Pat. No. 4,367,259 (Fulmer et al.), U.S. Pat. No. 4,374,935 (Decker et al.), U.S. Pat. No. 4,568,702 (Mascioli), U.S. Pat. No. 5,420,170 (Lutter et al.), U.S. Pat. No. 6,204,300 (Kageoka et al.) U.S. Pat. No. 6,495,611 (Arlt et al.), U.S. Patent Application Publication 2004/0266900 (Neff et al.), and European Patent 1641858 (Gummaraju), all incorporated herein by reference.

The pore size of the porous material will vary depending upon the composition and viscosity of the liquid that is to be dispensed. The term pore size is used to mean the size of the interstices of the material. The mean pore size can be determined by any standard test for determining porosity and pore size distribution. For example, mercury porosimetry is one method used to determine porosity and pore size.

The porous material may comprise a wide range of densities and specific gravities. In one embodiment, the density of the selected porous wicking material ranges from about 0.003 to about 0.009 ounces per cubic inch. The thickness of the porous material may range from about 10 mils to about 80 mils or more.

In another embodiment, there may be used a brush instead of a porous material which is positioned within or attached to the fluid applicator base. The brush serves to apply a fluid such as a liquid to an object. The brush may be made of an organic or natural material such as human hair or animal hair. Animal hair includes horse hair, camel hair, and goat hair. The brush may be made of other organic or natural materials similar to those used for the porous material including soft or stiff cotton, sponge, cloth, wool, plant fibers, bristles, and hemp. Animal fur and feathers are also contemplated. The brush may also be made of synthetic materials such as such as synthetic sponge, glass fibers, metal fibers and polymeric substances such as the polyamides and polyesters. The polyamides include nylon, nylon-6, and nylon-6,6. The polyesters include condensation polymers that contain an ester functional group in the primary or main chain such as polycarbonate and polyethylene terephthalate (PET).

In some applications, a fluid passage through-hole may be formed through the porous material or brush so as to enhance the flow of the fluid to one or more surfaces of the fastener. Depending upon the thickness of the porous material and the viscosity of the particular fluid to be flowed, fluid flow may be enhanced especially through thick porous material by forming a fluid passage hole through the porous material. This through-hole may be made by any suitable means such as a punch, needle, cutter, or the like so as to punch, pierce, cut or otherwise mechanically form the hole. The diameter of the porous material through-hole ranges from about 5 mils to about 150 mils, typically about 10 mils to about 50 mils. A mil is defined as 0.001 inch. The depth or thickness of the through-hole typically ranges from about 10 mils to about 80 mils or more.

The fluid applicator device may dispense a wide variety of fluids for preparing or treating an object, such as a protrusion on the surface or surfaces of the object. Such preparation or treatment include coating, cleaning, etching, and surface enhancing such as the application of adhesives, glues, fillers, pigments, corrosion resistant substances or the like. Multiple surfaces can be simultaneously treated.

Fluids

Fluid(s) as used herein includes liquid(s) or gas(es). Examples of liquids include silane, amino silane, urethane, isocyanates, diisocyanate, polyisocyanate, xylene, p-xylene, ketones such as methyl isobutyl ketone (MIBK) and methyl ethyl ketone (MEK), acids such as acetic acid (vinegar), boric acid, nitric acid (for etching) and vehicles and/or solvents such as ethers, acetone, glycols, alcohols including methyl alcohol and isopropyl alcohol, and benzene including alkyl benzenes such as methyl benzene (toluene) ethyl benzene, and propyl benzene. Toluene based fluids are contemplated, such as Chemlok® and lubricants. Chemlok® is a family of rubber to metal adhesives marketed by Lord Worldwide, Cary, N.C. A number of other liquids including vehicles and solvents may be used in addition to those listed herein. The selected liquid(s) may comprise a mixture of those listed above and/or other liquids not listed.

The liquid may contain selected solid particulates such as carbon black, which is suitable for ultraviolet (UV) screening and protection of the window seals in automobiles. The selected solid particulates may also comprise inorganic and organic pigments, fillers, dyes, and phosphors for selected applications comprising quality control and detection including quantitative and quality analyses.

Corrosion resistant conversion coatings may be applied. Such coatings are disclosed in U.S. Pat. No. 4,352,898 (Albers), U.S. Pat. No. 4,495,317 (Albers), U.S. Pat. No. 4,501,832 (Albers), U.S. Pat. No. 5,868,819 (Guhde et al.), U.S. Pat. No. 5,932,083 (Stoffer et al.), U.S. Pat. No. 6,818,116 (Stoffer et al.), U.S. Pat. No. 7,048,807 (Stoffer et al.), U.S. Pat. No. 7,241,371 (Stoffer et al.), U.S. Pat. No. 7,452,427 (Morris), U.S. Pat. No. 7,601,425 (Stoffer et al.), U.S. Pat. No. 7,759,419 (Stoffer et al.), U.S. Pat. No. 7,972,533 (Jaworowski et al.), U.S. Pat. No. 8,114,527 (Nagawawa et al.) and U.S. Patent Application Publication Nos. 2004/0249023 (Stoffer et al.), 2009/0065101 (Morris), 2011/0300390 (Morris), and European Patent 0571823 (Oldham et al.) all incorporated herein by reference.

Examples of inorganic solids or particulates include inorganic compounds of metals and/or metalloids including mixtures or combinations thereof. The inorganic compounds include, not by way of limitation, oxides, carbides, nitrides, nitrates, silicates, aluminates, sulfides, sulfates, phosphates, borosilicates, borides, and/or borates.

The metals and/or metalloids include, not by way of limitation, one or more selected from magnesium, calcium, strontium, barium, yttrium, lanthanum, cerium, neodymium, gadolinium, terbium, erbium, thorium, titanium, zirconium, hafnium, vanadium, niobium, tantalum, chromium, molybdenum, tungsten, manganese, rhenium, iron, ruthenium, osmium, cobalt, rhodium, iridium, nickel, copper, silver, zinc, cadmium, boron, aluminum, gallium, indium, thallium, carbon, silicon, germanium, tin, lead, phosphorus, and bismuth.

Specific inorganic compounds include titanium oxide(s), zinc oxide(s), magnesium oxide(s), aluminum oxide(s), zirconium oxide(s), silicon oxide(s), and silicon carbide(s) such as $TiO_2$, ZnO, MgO, $Al_2O_3$, $ZrO_2$, $SiO_2$, and/or SiC.

Other particulate solids include particles of glass, ceramic, glass ceramic, refractory, fused silica, quartz, or like amorphous and/or crystalline materials including mixtures of such. There may also be used particles of plastics, rubber, metals, and inorganic or organic luminescent materials such as phosphors.

Examples of organic particulates include polymeric substances such as acrylic, polyurethane, or epoxy synthetic resins dissolved in a suitable solvent. Such organic particulates may comprise one or more organic compounds, monomers, dimers, trimers, polymers, copolymers, or like organic or polymeric materials including organic dyes, dopants, and organic luminescent materials such as phosphors.

In one embodiment, the fluid is a gas such as air, steam, nitrogen, oxygen, carbon dioxide, rare gas or the like with finely divided solids or particulates suspended in the gas stream. The rare gas is selected from neon, argon, xenon, krypton, and helium including mixture thereof. The solids or particulates are as defined above.

The particulates are incorporated into the fluid by any suitable means such as a ball mill, fluid bed or a spray nozzle so as to provide a solution, dispersion, or suspension of the particulates in the fluid.

A peristaltic pump may be used to supply fluid to the fluid applicator. A peristaltic pump is a positive displacement pump also known as a dispense head roller drive. The fluid to be pumped is typically contained within a flexible tube fitted inside a casing. A rotor with cams (rollers, shoes, wipers) attached to the external surface of the casing compresses the flexible tub. As the rotor turns, that portion of the tube under compression closes or occludes thereby forcing the fluid to flow through the tube. As the tube opens to its natural uncompressed state after the passing of the cam, fluid flow is induced to the pump. Both circular and linear peristaltic pumps are contemplated.

The fluid applicator is generally used with low viscosity fluids typically about 200 centipoises (cps) or less. If the fluid has a viscosity above 200 cps, it may not be feasible to use a peristaltic pump.

The fluid applicator may be connected to a source of fluid by means of a flexible hose, tube, tubing, conduit, and so forth. The flexible hose or tube may be made of any suitable material such as plastic, rubber, or glass reinforced. Flexible plastic materials, including polymeric materials, such as polyvinyl chloride, polyethylene, polypropylene, and so forth are contemplated. The material is selected to be chemically compatible and resistant to the fluid flowing through the tube.

Anticorrosion Application

In one embodiment, the fluid applicator applies an anticorrosion substance to an object such as a structural fastener. Corrosion is the disintegration of an engineered material into its constituent atoms due to chemical reactions with its surroundings. In the most common use of the word, this means electrochemical oxidation of metals in reaction with an oxidant such as oxygen. Formation of an oxide of iron due to oxidation of the iron atoms in solid solution is a well-known example of electrochemical corrosion, commonly known as rusting. This type of damage typically produces oxide(s) and/or salt(s) of the original metal. Corrosion can also occur in materials other than metals, such as ceramics or polymers, although in this context, the term degradation is more common.

Many structural alloys corrode merely from exposure to moisture in the air, but the process can be strongly affected by exposure to certain substances. Corrosion can be concentrated locally to form a pit or crack, or it can extend across a wide area more or less uniformly corroding the surface. Because corrosion is a diffusion controlled process, it occurs on exposed surfaces. As a result, methods to reduce the activity of the exposed surface, such as passivation and chromate-conversion, can increase a material's corrosion resistance. However, some corrosion mechanisms are less visible and less predictable. The practice of this invention provides a fluid applicator apparatus and method for an improved application of a corrosion resistant substance to the surface of a protrusion such as a structural fastener. It may also be used to apply a corrosion resistant substance to a flat surface.

THE INVENTION

In accordance with this invention, there is provided a fluid applicator comprising a hollow body having an elongated axis with opposing ends and an opening or portal at each of the opposing ends, one or more porous materials positioned inside the hollow body along the elongated axis. In one embodiment, a first porous material contains a small female aperture and a second porous material contains a larger female aperture relative to the aperture in the first porous material. The larger aperture is formed to a predetermined depth and predetermined geometric shape so as to allow the larger aperture and the second porous material to cover a male surface protrusion of a given height or length and of a given geometric shape such that fluid uniformly flows from the second porous material to the protrusion.

In another embodiment, there is also an elongated pin having a flow control baffle at one end with notches or openings. The elongated pin is positioned between the opposing openings at each end of the fluid applicator and extends through the first porous material and into the second porous material. The pin may or may not include a covering of a third porous material on the tip of the pin.

In such embodiment, there is provided a fluid applicator for applying a fluid to a surface protrusion, said applicator comprising a hollow body having an elongated axis with opposing ends and an opening at each of the opposing ends, a first porous material positioned inside said hollow body along the elongated axis containing a small female aperture and a second porous material abutting the first porous material containing a larger female aperture relative to the aperture in the first porous material, the larger aperture being formed to a predetermined depth and geometric shape so as to allow the larger aperture and the second porous material to cover a male protrusion of a given height and geometric shape such that fluid uniformly flows from the second porous material to the protrusion, an elongated pin positioned between the opposing openings and extending through the small aperture of the first porous material into the larger aperture of the second porous material, the pin extending into a female opening in the male protrusion as the large aperture covers the protrusion such that fluid flows from the second porous material along the elongated pin into the female opening in the male protrusion.

The large female aperture depth is typically equal to or greater than the height or length of the protrusion. The geometric shape or form of the aperture may be the same or different geometric shape as the protrusion. The depth and geometric shape of the aperture may match the height (or length) and the geometric shape of the protrusion. The geometric shape of the aperture does not have to be the same as the protrusion as long as the shape or form is sufficient to uniformly apply the fluid to the protrusion.

The first and second porous materials may comprise two or more abutting sections with each section being made of the same porous material of the same composition. Each section may also be made of a porous material of a different composition.

The third porous material on the tip of the elongated pin may be made of the same porous material of the same composition as the first and second porous material sections. The third porous material section may also be made of a porous material of a different composition.

In an embodiment with two abutting sections, the fluid applicator comprises a hollow body having an elongated axis with opposing ends and an opening at each opposing end, a porous material positioned inside the hollow body along the elongated axis, the porous material being two separate sections, with one section of the porous material containing an aperture at one opening of the hollow body, the aperture having a predetermined depth and geometric shape sufficient to cover a surface protrusion such that fluid flowing from the porous material is uniformly applied to the protrusion.

In another embodiment, the fluid applicator comprises a hollow body having an elongated axis with opposing ends and an opening at each opposing end, a single porous material positioned inside the hollow body along the elongated axis, the porous material being one single section with the porous material containing an aperture extending from one opening of the hollow body, and a second aperture extending from the opposing opening of the hollow body. The second aperture has a predetermined depth and geometric shape sufficient to cover a surface protrusion such that fluid flowing from the porous material is uniformly applied to the protrusion.

As illustrated in the drawings, an elongated pin with a baffle at one end is provided to apply fluid to a protrusion having a female opening. The pin is positioned between the opposing openings and extends through the small aperture of the first porous material into the large aperture of the second porous material. The pin extends into the female opening in the male protrusion as the large aperture covers the protrusion. The pin may or may not include a porous material on the tip of the pin.

A baffle with notches or openings is provided at the opposite end of the elongated pin to uniformly flow fluid into the first porous material. The fluid flows through the porous material to the small aperture and along the surface of the elongated pin and into the female opening in the protrusion. Although the baffle and elongated pin are illustrated herein as a single piece, they may be two separate pieces In one application, the protrusion is a structural fastener and the fluid is a corrosion resistant conversion composition. The fastener is covered with a porous material and the anticorrosion substance is controllably flowed to the porous material so as to uniformly coat the fastener with the substance.

DETAILED DESCRIPTION OF THE DRAWINGS

Figure 1:
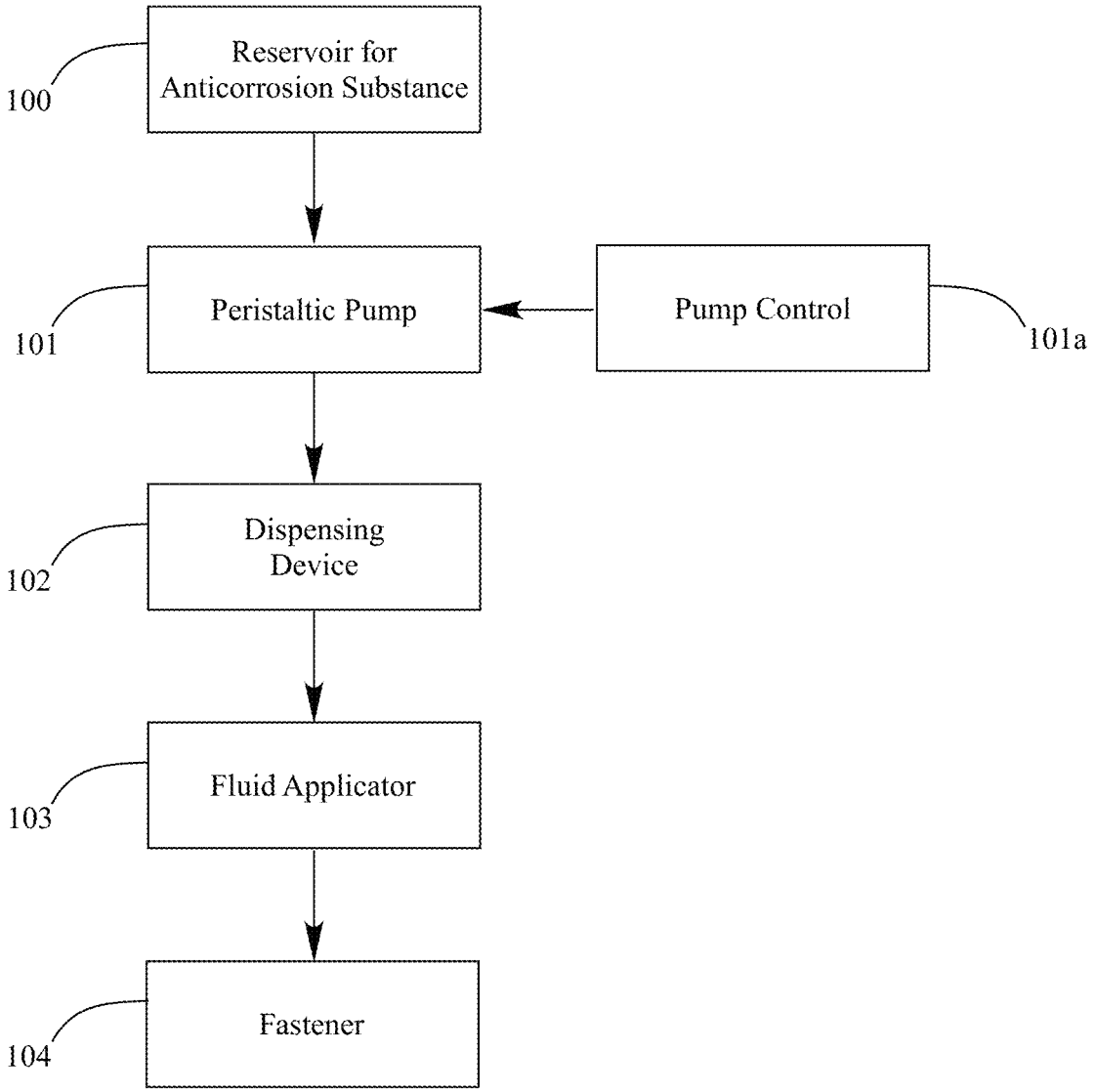
FIG. 1 is a block diagram of the fluid applicator method.

FIG. 1 is a block diagram of the overall method for applying a fluid such as an anticorrosion substance to an object such as a structural fastener. An anticorrosion substance is placed into the reservoir 100. The substance is pumped to the dispensing device 102 by a peristaltic pump 101 with pump controls 101*a*. The fluid applicator 103 is mounted on or in the dispensing device 102. The controls 101*a* and pump 101 controllably meter and flow the substance to the dispensing device 102 and fluid applicator 103. The fluid applicator 103 applies the anticorrosion substance uniformly to the fastener 104.

Figure 2:
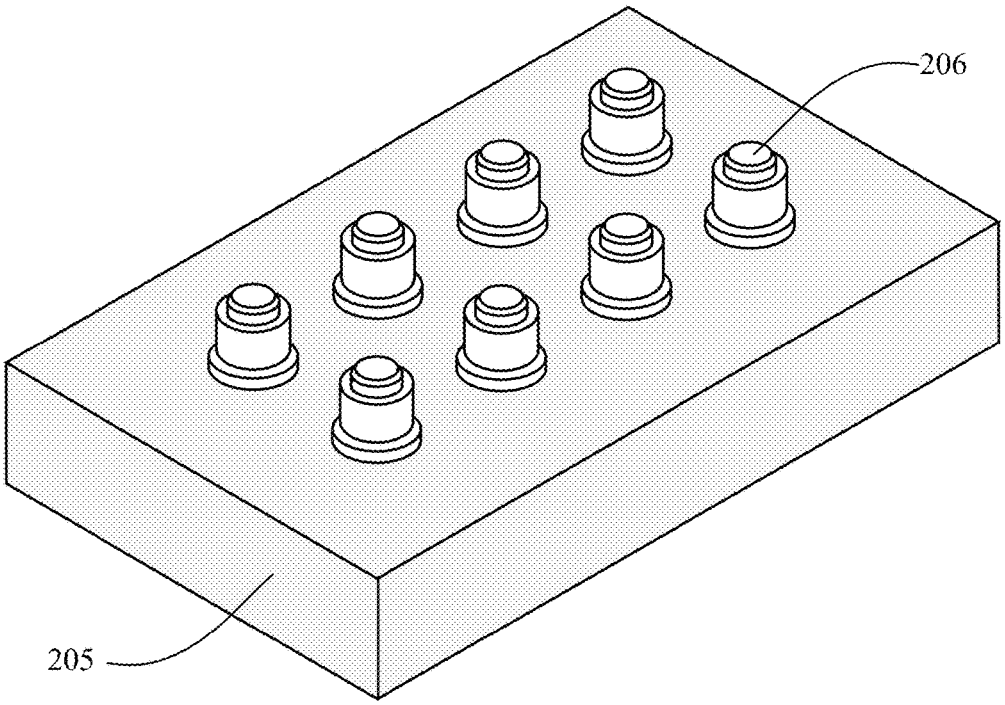
FIG. 2 is a perspective view of a substrate with structural fasteners.

FIG. 2 is a perspective view of a substrate 205 with structural fasteners 206.

Figure 2A:
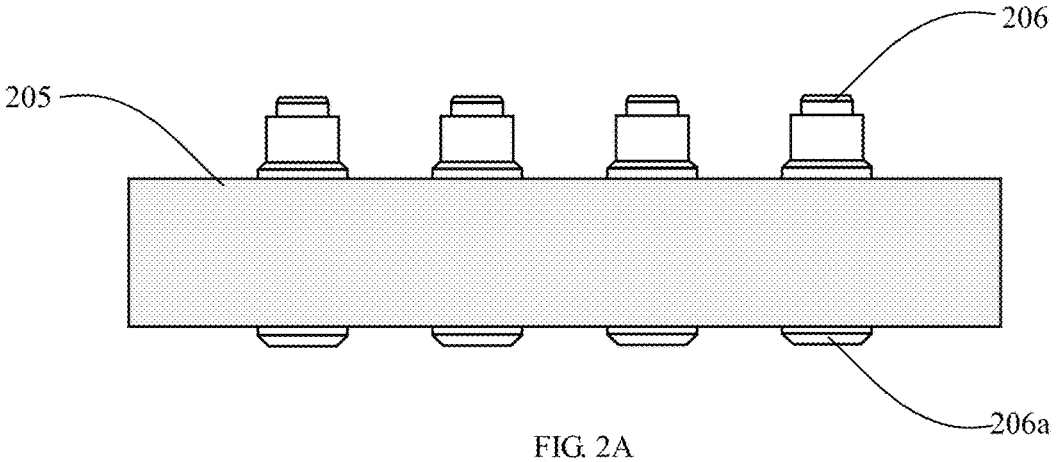
FIG. 2A is a side view of a substrate with structural fasteners.

FIG. 2A is a side view of a substrate 205 with structural fasteners 206 that extend through structural fasteners 206*a* and the substrate 205.

Figure 2B:
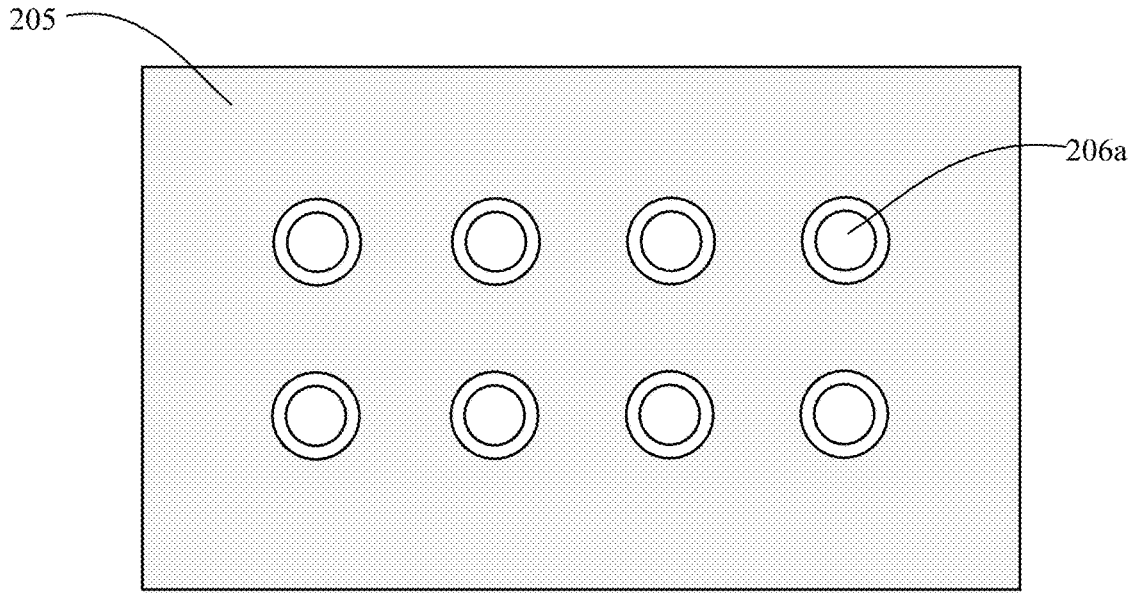
FIG. 2B is a bottom view of a substrate with structural fasteners.
Figure 3:
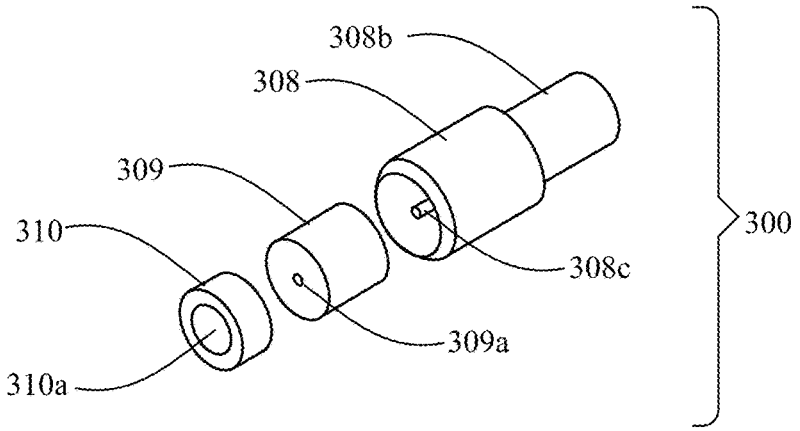
FIG. 3 is an exploded view of a fluid applicator.

FIG. 2B is a bottom view of a substrate 205 with structural fasteners 206*a*. Structural fasteners 206*a* can be solid or hollow FIG. 3 is an exploded view of a fluid applicator 300 comprising a hollow base 308, neck 308*b*, first porous material insert 309, and second porous material insert 310. The first porous material insert 309 has an aperture or opening 309*a* which may extend partly or completely through the length of the first porous material insert 309. The second porous material insert 310 has an aperture or opening 310*a* which may extend partly or completely through the length of the second porous material insert 310. An elongated pin 308*c* is located within the void of the of the hollow base 308 A baffle 308-1 (not shown) with notches or openings is at the proximal end of 308*c*. This is shown in other views below.

The neck 308*b* connected to the hollow base 308 is constructed out of the same or different material as the hollow base 308. The neck 308*b* is integral with the base 308. The fluid applicator 300 is connected to a source of fluid (not shown) for the flow of the fluid to the hollow base 308 from the source. The elongated pin 308*c* may be the same or a different material as the hollow base 308 and the neck 308*b*.

Figure 3A:
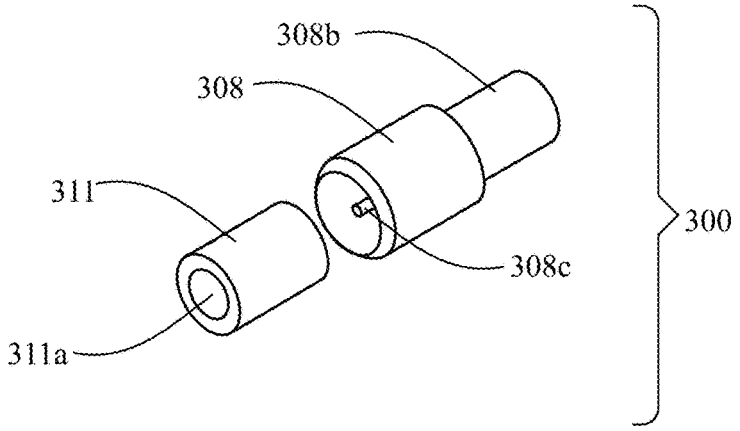
FIG. 3A is an alternate exploded view of a fluid applicator.

FIG. 3A is an exploded view of a fluid applicator 300 comprising a hollow base 308, neck 308*b*, a single porous material insert 311, and an aperture or opening 311*a* that extends partially through the length of the second porous material insert 311. An elongated pin 308*c* is located within the void of the of the hollow base 308.

Figure 3B:
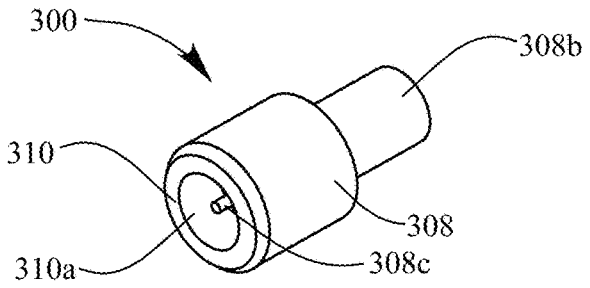
FIG. 3B is a perspective view of a fluid applicator.

FIG. 3B is a perspective view of a fluid applicator 300 comprising a base 308, neck 308*b*, first porous material insert 309 (not shown in the view), and second porous material insert 310. The second porous material insert 310 has an aperture or opening 310*a* which extends through the entire length of the second porous material insert 310, and an elongated pin 308*c* located within the void of the of the hollow base 308. The proximal end of the pin is in contact with the first porous material 309 (not shown). The distal end of the pin 308*c* extends through the void in the first porous material 309 (not shown) into the void of the second porous material 310*a*.

Figure 3E:
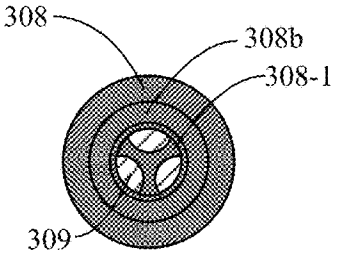
FIG. 3E is an end view of a fluid applicator.
Figure 3D:
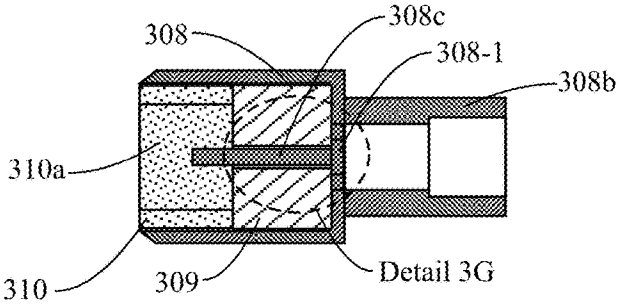
FIG. 3D is a section 3D-3D view of a fluid applicator.
Figure 3C:
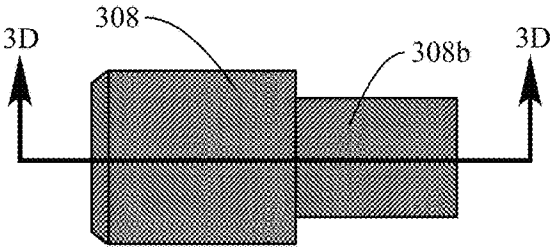
FIG. 3C is a side view of a fluid applicator.

FIG. 3C is a side view of a fluid applicator 300 comprising a base 308 at the distal end, neck 308*b* at the proximal end, first porous material insert 309 (not shown), and second porous material insert 310 (not shown).

FIG. 3D is a section 3D-3D view of a fluid applicator 300 comprising a base 308, neck 308*b*, first porous material insert 309, and second porous material insert 310. The second porous material insert 310 has an aperture or opening 310*a* which extends through the entire length of the second porous material insert 310, and an elongated pin 308*c* is located within the void of the of the hollow base 308. The proximal end of the pin 308*c* is in contact with the first porous material 309. The distal end of the pin 308*c* extends through the void in the first porous material (see Detail 3G) into the void of the second porous material 310*a*.

FIG. 3E is a proximal end view of a fluid applicator 300 comprising a base 308, neck 308*b*, first porous material insert 309, and baffle 308-1

Figure 3G:
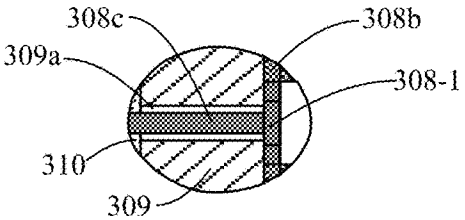
FIG. 3G is a Detail 3G view of a fluid applicator.
Figure 3F:
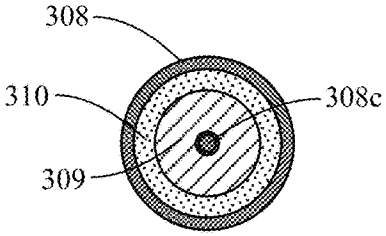
FIG. 3F is an end view of a fluid applicator.

FIG. 3F is a distal end view of a fluid applicator comprising a base 308, first porous material insert 309, second porous material insert 310, and an elongated pin 308*c*.

FIG. 3G is a Detail 3G view of a fluid applicator neck 308*b*, first porous material insert 309, a void in the first porous material 309*a*, second porous material 310, and an elongated pin 308*c*.

Figure 3I:
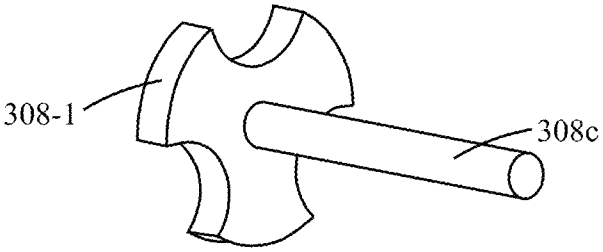
FIG. 3I is a perspective view of an elongated pin and baffle.
Figure 3H:
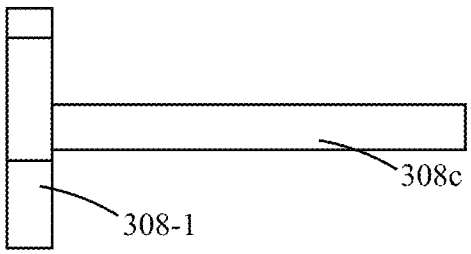
FIG. 3H is a side view of an elongated pin and baffle.

FIG. 3H is a side view of an elongated pin 308*c* with baffle 308-1. The proximal end is the baffle 308-1. The baffle 308-1 is a flange with notches or openings to allow a fluid to pass through the first porous material 309 (not shown) and through aperture 309*a* (not shown) so as to direct the flow of the fluid along the surface of the pin 308*c*.

FIG. 3I is a perspective view of an elongated pin 308*c* and baffle 308-1. The proximal end has a baffle 308-1 comprising a flange with notches to allow a fluid to pass through the first porous material 309 (not shown). The baffle holds the first porous material 309 (not shown) in place while directing the flow of the fluid.

Figure 3J:
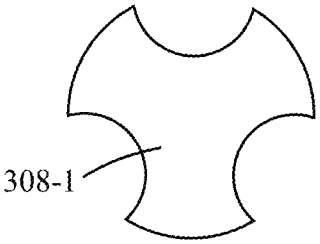
FIG. 3J is a proximal view of the baffle.

FIG. 3J is a proximal end view of FIG. 3H showing the baffle 308-1.

Figure 3K:
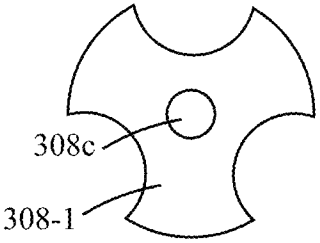
FIG. 3K is a distal end view of the baffle and the elongated pin.

FIG. 3K is a distal end view of an elongated pin 308*c* showing the baffle 308-1.

Figure 4:
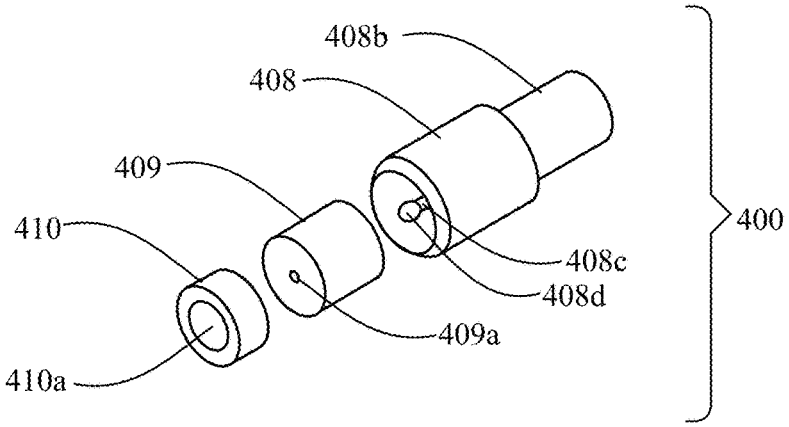
FIG. 4 is an exploded view of a fluid applicator.

FIG. 4 is an exploded view of a fluid applicator 400 comprising a hollow base 408, neck 408*b*, first porous material insert 409, and second porous material insert 410. The first porous material insert 409 has an aperture or opening 409*a* which may extend partly or completely through the length of the first porous material insert 409. The second porous material insert 410 has an aperture or opening 410*a* which may extend partly or completely through the length of the second porous material insert 410. An elongated pin or pin 408*c* is located within the void of the of the hollow base 408 and has a third porous material 408*d* on the distal end of the pin.

The neck 408*b* connected to the hollow base 408 is constructed out of the same or different material as the hollow base 408. The neck 408*b* is integral with the base 408. The fluid applicator 400 is connected to a source of fluid (not shown) and contains a passage (not shown) for the flow of fluid to the hollow base 408 from the source. The an elongated pin 408*c* may be the same or different material as the hollow base 408 and the neck 408*b*. A second porous material 408*d* is located on the distal end of the pin 408*c*.

Figure 4A:
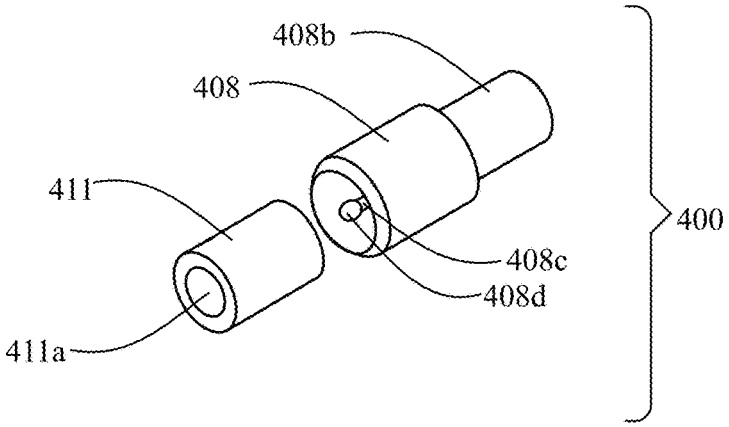
FIG. 4A is an alternate exploded view of a fluid applicator.

FIG. 4A is an exploded view of a fluid applicator 400 comprising a hollow base 408, neck 408*b*, a single porous material insert 411, and an aperture or opening 411*a* that extends partially through the length of the second porous material insert 411. An elongated pin 408*c* is located within the void of the hollow base 408 with a second porous material 408*d* on the distal end of the pin 408*c*. In this embodiment, the porous material 409 and 410 have been combined into a single porous material 411.

Figure 4B:
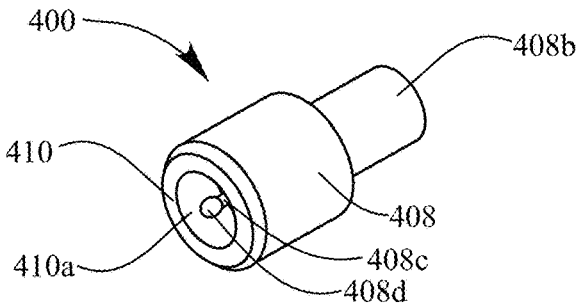
FIG. 4B is a perspective view of a fluid applicator.

FIG. 4B is a perspective view of a fluid applicator 400 comprising a base 408, neck 408*b*, first porous material insert 409 (not shown), and second porous material insert 410. The second porous material insert 410 has an aperture or opening 410*a* which extends through the entire length of the second porous material insert 410, and an elongated pin or pin 408*c* located within the void of the hollow base 408. The proximal end of the pin is in contact with the first porous material 409 (not shown). The distal end of the pin 408*c* extends through the void in the first porous material 409 (not shown) into the void of the second porous material 410*a* exposing the distal end of the pin 408*c* with a third porous material 408*d* on the distal end of the pin.

Figure 4E:
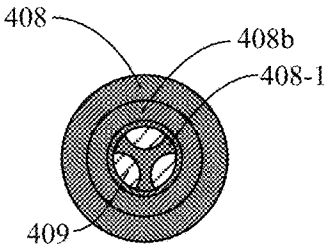
FIG. 4E is an end view of a fluid applicator.
Figure 4D:
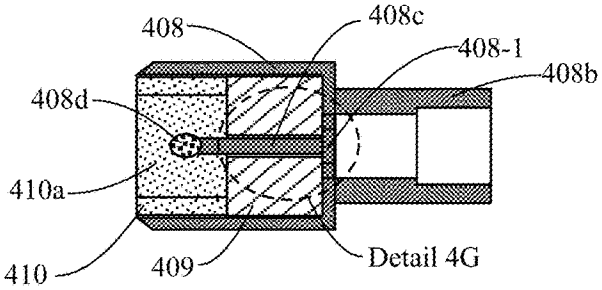
FIG. 4D is a section 4D-4D view of a fluid applicator.
Figure 4C:
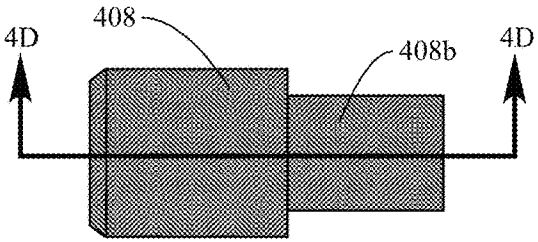
FIG. 4C is a side view of a fluid applicator.

FIG. 4C is a side view of a fluid applicator 400 comprising a base 408 at the distal end, neck 408*b* at the proximal end, first porous material insert 409 (not shown), and second porous material insert 410 (not shown).

FIG. 4D is a section 4D-4D view of a fluid applicator 400 comprising a base 408, neck 408*b*, first porous material insert 409, and second porous material insert 410. The second porous material insert 410 has an aperture or opening 410*a* which extends through the entire length of the second porous material insert 410, and an elongated pin or pin 408*c* located within the void of the of the hollow base 408 with a third porous material 408*d* at the distal end. The proximal end of the pin 408*c* is in contact with the first porous material 409 and a baffle 408-1. The distal end of the pin 408*c* extends through the void in the first porous material 409 (see Detail 4G) into the void of the second porous material 410*a*.

FIG. 4E is a proximal end view of a fluid applicator 400 comprising a base 408, neck 408*b*, first porous material insert 409, and a baffle 408-1.

Figure 4G:
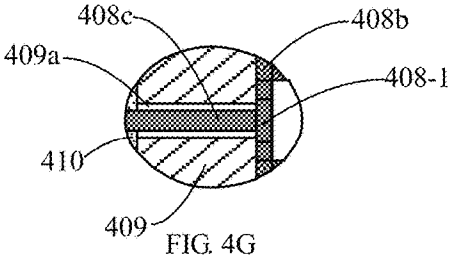
FIG. 4G is a Detail 4G view of a fluid applicator.
Figure 4F:
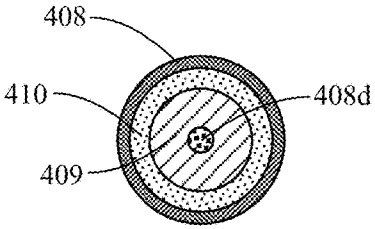
FIG. 4F is an end view of a fluid applicator.

FIG. 4F is a distal end view of a fluid applicator 400 comprising a base 408, first porous material insert 409, second porous material insert 410, and a third porous material 408*d* on the distal end of the pin 408*c* (not shown).

FIG. 4G is a Detail 4G view of a fluid applicator neck 408*b*, first porous material insert 409, a void in the first porous material 409*a*, second porous material 410, and an elongated pin 408*c* and baffle 408-1.

Figure 4I:
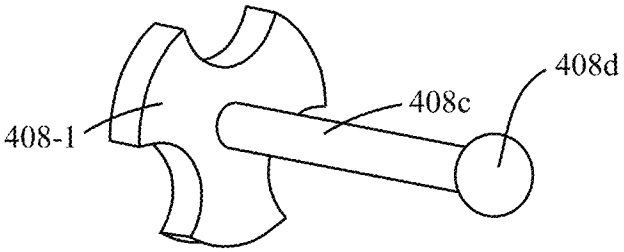
FIG. 4I is a perspective view of an elongated pin and baffle.
Figure 4K:
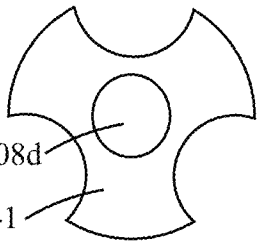
FIG. 4K is a distal end view of the elongated pin and baffle.
Figure 4H:
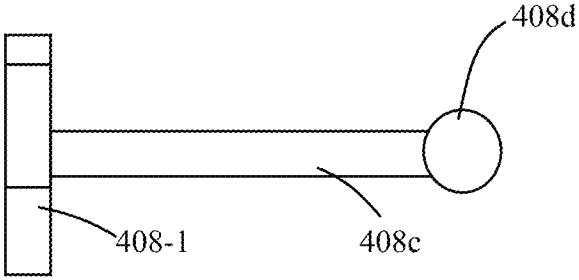
FIG. 4H is a side view of an elongated pin and baffle.

FIG. 4H is a side view of an elongated pin 408*c* with baffle 408-1. The proximal end has a baffle 408-1. The baffle 408-1 is a flange with notches or openings to allow a fluid to pass through the first porous material 409 (not shown) in place and through aperture 409*a* (not shown) so as to direct the flow of fluid along the surface of pin 408*c*.

FIG. 4I is a perspective view of an elongated pin 408*c* and baffle 408-1. The proximal end has a baffle 408-1 comprising a flange with notches to allow a fluid to pass through the first porous material 409 (not shown). The baffle 408-1 holds the first porous material 409 (not shown) in place while directing the flow of the fluid along the surface of pin 408*c*.

Figure 4J:
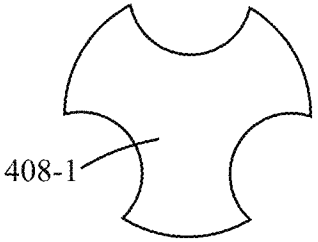
FIG. 4J is a proximal view of the baffle.

FIG. 4J is a proximal end view of FIG. 4H showing the baffle 408-1.

FIG. 4K is a distal end view of an elongated pin 408*c* and baffle 408-1.

The fastener can be of any geometric shape or dimension including any diameter or length. Types of fasteners include aerospace bolts, rivets, screws, and studs which protrude partially or completely through a substrate such as a section of a wing, external fuselage, or internal structural support of an aircraft.

In one embodiment, the anticorrosion coating is applied to the threaded section of a threaded lockbolt. In another embodiment, the lockbolt has a collar that is coated. In another embodiment, the lockbolt has a protruding round or flat head that is coated.

The fluid applicator has a female aperture of porous material that fits over the male protrusion such as a fastener so that the porous material covers and is in contact with the fastener. The anticorrosion substance flows into the hollow body and into the porous material and is dispensed as a uniform coating on the fastener.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined by the appended claims.

The invention claimed is:

1. In a fluid applicator for applying a fluid to a surface protrusion, said applicator comprising a hollow body having an elongated axis with opposing ends and an opening at each of the opposing ends, the improvement wherein a porous material is positioned inside the hollow body along the elongated axis, the porous material containing an aperture at one end and opening of the hollow body, said porous material aperture having a predetermined depth and diameter so as to match the height and the geometric shape of the surface protrusion and cover the surface protrusion such that fluid flowing from the porous material is uniformly applied to the protrusion.

2. The invention of claim 1 wherein the porous material comprises two or more abutting sections.

3. The invention of claim 2 wherein each section is made of the same porous material.

4. The invention of claim 1 wherein the protrusion is a structural fastener.

5. The invention of claim 1 wherein the fluid is a corrosion resistant conversion composition.

6. In a fluid applicator for applying a fluid to a surface protrusion, said applicator comprising a hollow body having an elongated axis with opposing ends and an opening at each opposing end, a porous material positioned inside the hollow body along the elongated axis, said porous material comprising two separate sections, one section of the porous material containing an aperture at one opening of the hollow body, said aperture having a predetermined depth and geometric shape to allow the porous material to cover a surface protrusion such that fluid flowing from the porous material is uniformly applied to the protrusion.

7. The invention of claim 6 wherein the protrusion is a structural fastener.

8. The invention of claim 6 wherein the fluid is a corrosion resistant conversion composition.

* * * * *